United States Patent [19]

Groves

[11] 4,228,602

[45] Oct. 21, 1980

[54] SKI BOOT ATTACHMENT

[76] Inventor: E. Stuart Groves, Sanders Rd., Hudson, N.H. 03051

[21] Appl. No.: 966,877

[22] Filed: Dec. 6, 1978

[51] Int. Cl.[2] ..... A43B 5/00; A43B 3/10; A43D 5/00

[52] U.S. Cl. ..... 36/132; 36/7.6; 12/120.5

[58] Field of Search ..... 36/132, 7.5, 7.6, 1; 12/120.5

[56] References Cited

U.S. PATENT DOCUMENTS

| | | | |
|---|---|---|---|
| 3,210,787 | 10/1965 | Allsop | 12/120.5 |
| 3,412,866 | 11/1968 | Binding | 12/120.5 |

FOREIGN PATENT DOCUMENTS

| | | | |
|---|---|---|---|
| 2617257 | 1/1977 | Fed. Rep. of Germany | 36/132 |

*Primary Examiner*—Patrick D. Lawson

*Attorney, Agent, or Firm*—Morse, Altman, Oates & Bello

[57] ABSTRACT

A walking attachment is provided for use with ski boots to permit booted skiers to walk upright on foot. The attachment is formed with a generally flat upper surface substantially coextensive with the length and width of the boot sole, while the bottom surface of the attachment is curved from end to end. A hinged bail is provided at the rear end of the attachment for gripping engagement with the heel portion of the boot while a spring loaded, retractable clamp is mounted to the forward portion of the attachment for detachably engaging the toe portion of the boot.

8 Claims, 7 Drawing Figures

SKI BOOT ATTACHMENT

BACKGROUND OF THE INVENTION

1. Field of the Invention

This invention relates generally to ski boot attachments and more particularly is directed towards a new and improved detachable sole device adapted to allow a skier wearing a boot with a rigid sole and an inclined ankle portion to walk upright when the skiis are removed.

2. Description of the Prior Art

Modern ski boots are formed with a stiff flat sole which connects flat against the top of the ski and does not normally flex. In addition to the stiff flat sole, the modern boot is formed with a stiff ankle-engaging upper portion which is inclined forwardly in order to provide a greater comfort for the skier who normally skiis in a crouched or semi-crouched position. Thus, the boot is idealy designed for use in skiing. However, the design features of the boot that provide many desirable advantages while skiing produce a boot that is ill adapted for walking. Thus, when the skier has removed his skiis and walks about, he finds that he must walk in a slightly crouched position with his knees bent and in a rather flat footed manner. The forced crouch is both awkward and uncomfortable.

While it has been proposed to provide detachable lifts for the fore portion of the ski boots in order to alleviate this problem, none of the devices heretofore available has been satisfactory from the standpoint of ease of walking, simplicity of operation and convenience in connecting and disconnecting attachment to and from the boot.

Accordingly, it is an object of the present invention to provide improvements in walking attachments for ski boots.

Another object of this invention is to provide a ski boot walking attachment that is simple and easy to install and is comfortable and convenient to wear.

Another object of this invention is to provide a ski boot walking attachment adapted to fit a variety of different size ski boots without adjustment.

SUMMARY OF THE INVENTION

This invention features a ski boot walking attachment comprising a body portion of generally rectangular outline and corresponding generally in size and shape with an average size ski boot sole. The body portion is formed with a flat upper surface for fitting the same against the bottom of the boot sole. The bottom portion of the attachment is straight transversely but curved end-to-end, being slightly thicker at the forward end thereof. A hinged bail is attached to the rear portion of the body portion to engage the heel end of the boot sole while the forward portion is provided with a spring loaded retaining clamp to engage the toe portion of the boot sole. The body portion is formed with a longitudinal passages containing coil springs which are connected at their forward ends to the clamp and at their rear ends to a transverse axle to which the rear bail is hinged.

DETAILED DESCRIPTION OF THE PREFERRED EMBODIMENT

Figure 1:
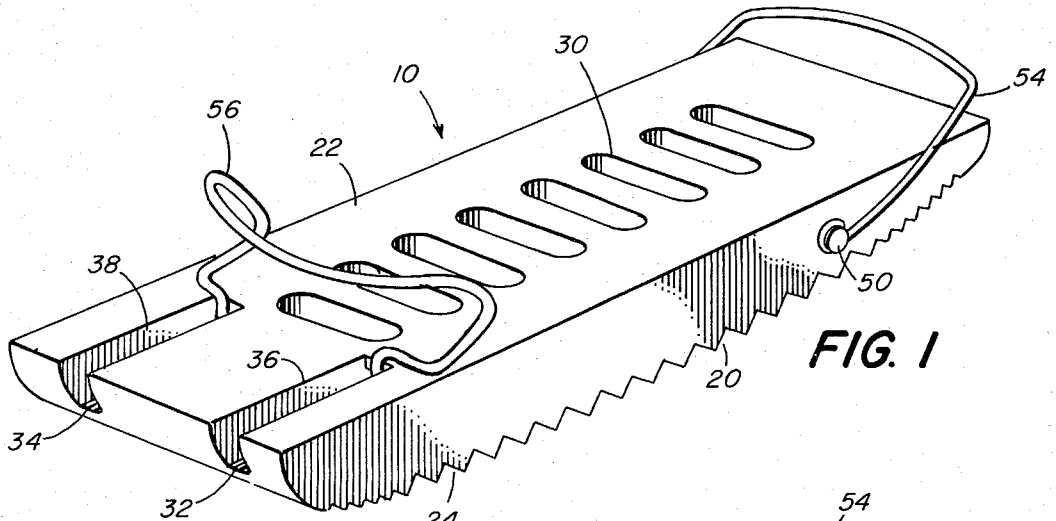
FIG. 1 is a view in perspective of a ski boot walking attachment made according to the invention.
Figure 5:
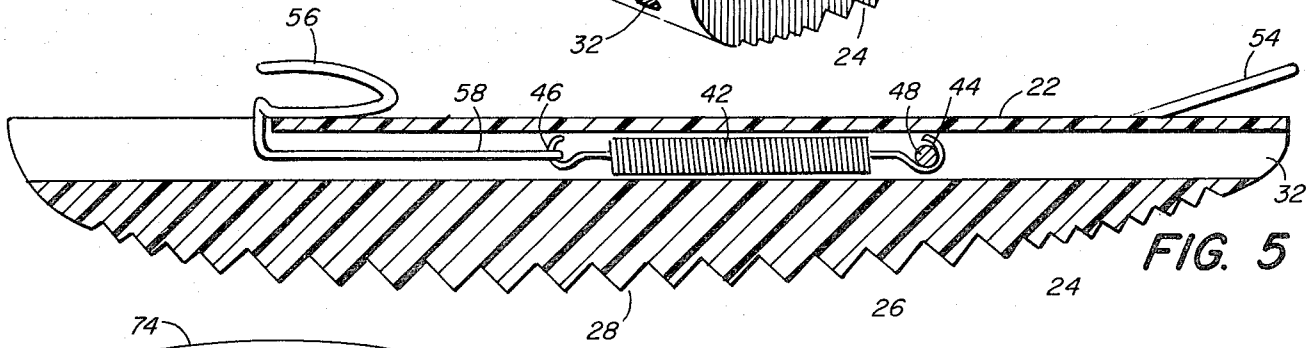
FIG. 5 is a sectional view in side elevation of the attachment.

Referring now to the drawings, the reference character 10 generally indicates a walking attachment for use with ski boot 12 particularly of the sort characterized by a flat and substantially rigid sole 14 and an upper 16 having a forwardly inclined ankle-engaging portion 18. The upper typically is of a very stiff and relatively inflexible material which, in practice, frequently is fabricated by injection molding of a hard plastic so that the boot, when fitted to the skier, will firmly engage the foot and ankle portion to such an extent that the angle between the foot and the lower leg is fixed so as to conform to the bent knee, crouched position usually employed by skiers while skiing. The boot thus is designed to conform to the angle between the foot and the lower leg with the leg bent in the manner of FIG. 6. While the boot is comfortable when skiing in the normal crouched position shown in FIG. 6, it becomes uncomfortable and awkward when the skier removes his skiis and attempts to walk about on foot since he cannot straighten his legs. The discomfort is increased by virtue of the fact that the sole 14 is flat and stiff and will not flex. The attachment 10 when connected to the sole 14 of the boot 12 facilitates walking with such boots by first of all allowing the skier to stand and walk in a normal upright position as suggested in FIG. 7 and to provide a contoured tread surface which compensates for the rigidity of the sole by allowing a certain rocking action when walking.

Figure 4:
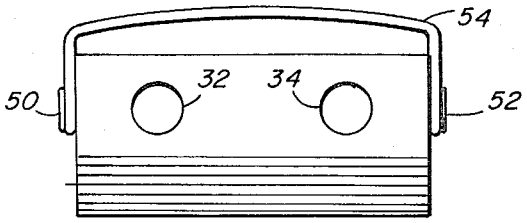
FIG. 4 is a view in rear elevation thereof.
Figure 3:
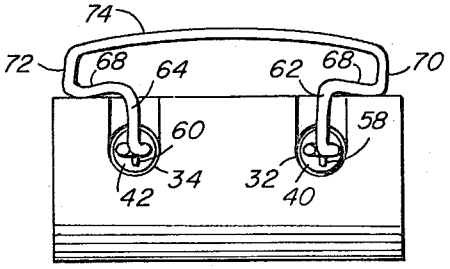
FIG. 3 is a view in front elevation thereof.

The attachment is comprised of a body portion 20 which is generally rectangular in top plan view having a width and length that generally correspond with the dimensions of a sole of a typical ski boot. In practice the body 20 may be on the order of $11\frac{1}{2}''$ or so in overall length and width of perhaps of $\frac{3}{4}''$. Obviously, the dimensions may be altered or the device may be provided in several different sizes to fit childrens boots or oversized boots. The body 20 is relatively thick, particularly in the mid-portion thereof, and in practice a thickness near the center of perhaps $1\frac{1}{2}''$ has been found to produce satisfactory results. The lower face or walking surface of the attachment is curved from end to end although it is straight in a transverse direction, as shown in the FIGS. 3 and 4. Preferably, the thickest portion of the body 20 is closer to the front of the attachment than it is to the rear in order to provide a lift to the forward portion of the boot sufficient to offset the fixed angle between the boot sole and ankle portion 18. The upper surface 22 is generally flat to mate flush with the flat bottom of the boot sole 14. The curved bottom surface 24 of the attachment is formed with transverse V-shaped grooves 26 providing a gripping tread face particularly useful for walking in snow. The grooves are formed in spaced parallel relation transversely across most of the tread face and, preferably, the grooves are deeper in the mid portion than at the end portions.

In order to reduce the weight of the attachment, cavities 30 may be formed in the body, preferably through the upper surface 22 thereof. In practice, the body may be fabricated from a variety of materials such as wood, metal, rubber or the like although, a relatively rigid or semi-rigid elastomer material is preferred. Urethane is a particularly desirable material for the body because of its strength and wear characteristics although other materials may be used to advantage. By providing cavities in the body, the cure time of the urethane is reduced, thereby facilitating its production. Urethane is easily molded by well known techniques to allow ease of production.

Extending from end-to-end of the body portion is a pair of spaced parallel passages 32 and 34, preferably of circular cross-section. The passages 32 and 34 extend parallel to the top surface 22 with the main portion of the passages being disposed below the top surface thereof. The rear ends of the passages 32 and 34 terminate flush with the rear end of the body while the forward end of each passage is cut away at 36 and 38 which open to the top surface 22 defining slots at the forward ends of the body. Mounted within the passages 32 and 34 are resilient elements such as coil springs 40 and 42, each provided with hook ends 44 and 46. Rubber bands, or the like may also be used in place of the coil springs. The rear hook 44 engages a transverse pin or axle 48 extending through the rear portion of the body 20 and terminating with enlarged heads 50 and 52 one at each side of the body. Hinged to the outer ends of the pin 44 and retained by the heads 50 and 52 is a bail 54 of relatively stiff wire or the like. The bail defines a hoop, arching from side to side of the rear portion of the body and typically extending out from the pin perhaps 4". In practice, the pin 48 is set back from the rear end of the body portion by perhaps 3½" with the top of the bail thereby normally extending diagonally to the rear and somewhat above the upper face of the body in position to engage the heel part of the sole 14, as shown in FIG. 2.

The forward hook 46 for each spring engages the inner end of a clamp 56 located towards the forward end of the body. The clamp 56 is formed with a pair of straight, generally parallel lower legs 58 and 60, the rear ends of which engage the forward ends of the coil springs. The legs 58 and 60 extend forwardly of the passages 32 and 34 and are bent into upright segments 62 and 64 which, in turn, are bent into outwardly extending segments 66 and 68 and thence are bent into rearwardly, upwardly extending portions 70 and 72 which merge into a forwardly bent arched upper portion 74 adapted to fit over the upper edge of sole at the toe in the manner shown in FIG. 2.

In practice, the attachment is fitted to a boot preferably by the skier first placing his boot on top of the attachment with the toe portion of the sole engaging the clamp 56. He then tilts the boot and the attachment forwardly while pushing against the clamp until it is drawn forwardly for a distance sufficient for the bail 54 to be swung up over the heel of the boot to engage the sole. Removal of the attachment is carried out by reversing this procedure.

Figures 2, 6, 7:
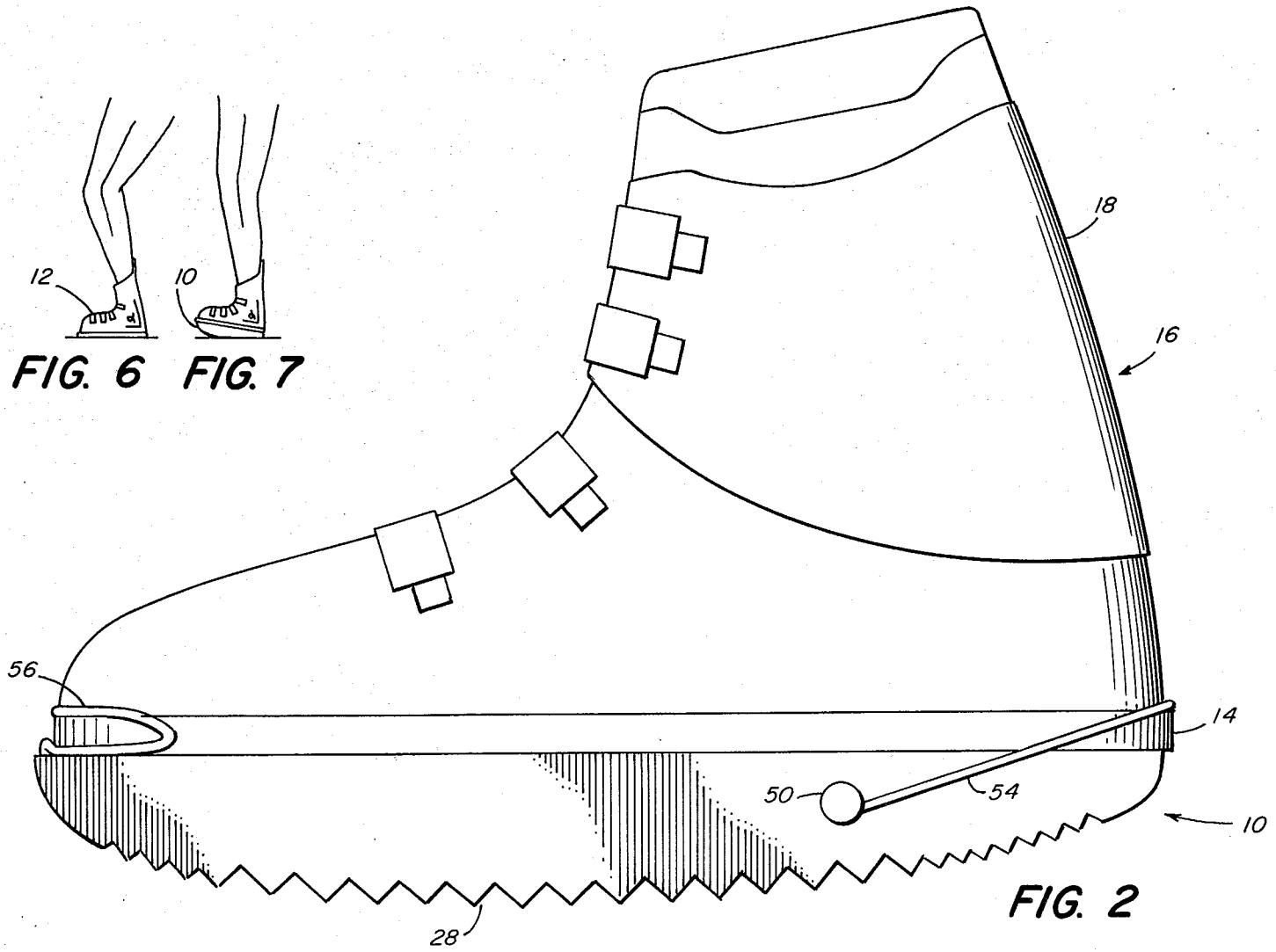
FIG. 2 is a view in side elevation thereof, with a boot in place.
FIG. 6 is a side view of a typical ski boot worn without an attachment, and, FIG. 7 is a view similar to FIG. 6 but showing the attachment in place.

With the attachment in place the skier is now able to stand upright as shown in FIG. 7 and, by virtue of the curved lower tread face of the attachment, he is able to walk along using a somewhat rocking motion which has been found to be more comfortable than the flat footed motion imposed by the stiff boot without the attachment.

The spring loaded clamp not only firmly grips the attachment to the boot, but also allows the attachment to be fitted to a variety of different boot sizes so that the one walker attachment size can fit conveniently to a number of different boot sizes. A total of three or four sizes of attachments should cover almost all sizes of boots. The attachments are relatively small and light and can be carried while skiing by placing the same in the pocket for example.

While the invention has been described with particular reference to the illustrated embodiment, numerous modifications thereto will appear to those skilled in the art.

Having thus described the invention, what I claim and desire to obtain by Letters Patent of the United States is:

1. An attachment for ski boots and the like, comprising (a) a body portion having a length and width generally corresponding with the length and width of the sole of a boot to which the body portion is to be attached.

(b) said body portion being formed with a generally flat upper face and a longitudinally curved and transversely straight lower tread face, (c) said body portion being thicker at the mid-portion thereof than at the ends thereof, (d) a bail hinged to the rear part of said body portion and adapted to engage the heel portion of a boot placed on said upper face, and, (e) a longitudinally retractable spring loaded clamp mounted to the forward end of said body portion and adapted to engege the toe portion of said boot, (f) said body portion being formed with at least one longitudinal passage therethrough, a resilient element disposed in said passage, a pin extending transversely through said body portion and engaging the rearward end of said element and pivotally connected at its ends to said bail, the forward end of said element connected to said clamp, (g) the forward end of said body portion being formed with a longitudinal slot through the upper face thereof and in communication with said passage.

2. An attachment according to claim 1 wherein said clamp is in the form of a generally stiff arched hoop formed with a pair of straight longitudinally extending lower legs and an upwardly and forwardly extending center portion.

3. An attachment according to claim 1 wherein said element is a coil spring.

4. An attachment according to claim 1 wherein said element is an elastic band.

5. An attachment for ski boots and the like, comprising (a) a body portion having a length and width generally corresponding with the length and width of the sole of a boot to which the body portion is to be attached, (b) said body portion being formed with a generally flat upper face and a longitudinally curved and transversely straight lower tread face, (c) said body portion being thicker at the mid-portion thereof than at the ends thereof, (d) a bail hinged to the rear part of said body portion and adapted to engage the heel portion of a boot placed on said upper face, and, (e) a longitudinally retractable spring loaded clamp mounted to the forward end of said body portion and adapted to engage the toe portion of said boot, (f) said body portion being formed with a pair of parallel longitudinal passages extending from end-to-end thereof, a resilient element disposed in each passage, a pin transversely through said body portion and engaging the rearward ends of both elements and pivotally connected at its ends to said bail, the forward ends of said elements connected to said clamps, (g) the forward end of said body portion being formed with a pair of parallel longitudinal slots through the upper face thereof and in communication with said passages.

6. An attachment according to claim 5 wherein said clamp is in the form of a generally stiff arched hoop formed with a pair of straight longitudinally extending lower legs and an upwardly and forwardly extending center portion.

7. An attachment according to claim 5 wherein said elements is a coil spring.

8. An attachment according to claim 5 wherein said element is an elastic band.

* * * * *